US012313060B2

(12) United States Patent
Fontanesi et al.

(10) Patent No.: US 12,313,060 B2
(45) Date of Patent: May 27, 2025

(54) ZEROING DEVICE

(71) Applicant: Dana Motion Systems Italia S.R.L., Reggio Emilia (IT)

(72) Inventors: Luca Fontanesi, Reggio Emilia (IT); Alessandro Sassi, Reggio Emilia (IT); David Gambuzzi, Reggio Emilia (IT)

(73) Assignee: DANA MOTION SYSTEMS ITALIA S.R.L., Reggio Emilia (IT)

( * ) Notice: Subject to any disclaimer, the term of this patent is extended or adjusted under 35 U.S.C. 154(b) by 0 days.

(21) Appl. No.: 18/500,892

(22) Filed: Nov. 2, 2023

(65) Prior Publication Data

US 2024/0151225 A1 May 9, 2024

(30) Foreign Application Priority Data

Nov. 3, 2022 (DE) ..... 20 2022 106 186.6

(51) Int. Cl.
*F04B 53/14* (2006.01)
*F01B 3/00* (2006.01)
*F04B 19/22* (2006.01)

(52) U.S. Cl.
CPC ..... *F04B 53/14* (2013.01); *F01B 3/007* (2013.01); *F04B 19/22* (2013.01)

(58) Field of Classification Search
CPC ..... F01B 3/007; F04B 1/2042; F04B 1/32; F04B 53/14
See application file for complete search history.

(56) References Cited

U.S. PATENT DOCUMENTS 3,221,660 A * 12/1965 D'Amato ..... F04B 1/324 417/222.1
4,723,892 A * 2/1988 Cowan ..... F04B 1/324 417/222.1

FOREIGN PATENT DOCUMENTS

JP 2005042724 A * 2/2005 ..... F01B 3/007

* cited by examiner

*Primary Examiner* — Abiy Teka
(74) *Attorney, Agent, or Firm* — McCoy Russell LLP

(57) ABSTRACT

The present disclosure relates to a zeroing device comprising a piston movable along an axis, at least one biasing member for biasing the piston along the axis, and an axially displaceable zeroing member limiting axial movement of the at least one biasing member. The present disclosure further relates to a variable displacement hydraulic unit including said zeroing device.

18 Claims, 11 Drawing Sheets

ZEROING DEVICE

CROSS-REFERENCE TO RELATED APPLICATION

The present application claims priority to German Utility Model Application No. 20 2022 106 186.6, entitled "ZEROING DEVICE", and filed Nov. 3, 2022. The entire contents of the above-listed application is hereby incorporated by reference for all purposes.

TECHNICAL FIELD

The present disclosure relates to a zeroing device for adjusting a zero position of a piston such as a hydraulic piston, and to a variable displacement hydraulic unit including the zeroing device. The variable displacement hydraulic unit may include a variable displacement hydraulic pump or a variable displacement hydraulic motor, for example.

BACKGROUND AND SUMMARY

Zeroing devices are used, for example, in order to move a piston from a deflected position to a zero position. For instance, the piston may be a servo piston coupled to a swashplate of a variable displacement hydraulic unit for controlling a stroke of one or more delivery pistons. The zero position of the servo piston may then correspond to a vanishing stroke of the delivery pistons of the variable displacement hydraulic unit.

Known zeroing devices often include one or more return springs to return the piston to its zero position. However, over time the return springs may experience material fatigue which may impair their ability to define the zero position of the piston with a sufficient degree of accuracy.

Thus, there is demand for a zeroing device configured to define a zero position of a piston with a sufficient degree of accuracy over extended periods of time.

This demand is met by a zeroing device including as described herein and by a variable displacement hydraulic unit including said zeroing device.

The presently proposed zeroing device comprises at least a piston such as a servo piston movable along an axis, at least one biasing member for biasing the piston along the axis, and an axially displaceable zeroing member configured to limit or limiting axial movement of the at least one biasing member.

By axially displacing the zeroing member configured to limit or limiting axial movement of the at least one biasing member, a zero position of the piston along the axis may be set with good accuracy even over extended periods of time.

The zeroing device may comprise a rotatable gudgeon including an eccentric pin engaged with the zeroing member. The zeroing member may then be displaceable along the axis by rotating the rotatable gudgeon. This solution may be economical and easy to use.

The zeroing device may comprise a worm screw or lead screw engaged with the zeroing member. The zeroing member may then be displaceable along the axis by rotating the worm screw. This solution, too, may be economical and easy to use.

The at least one biasing member may include a first biasing member configured to bias the piston in a first direction along the axis, wherein the zeroing member limits axial movement of the first biasing member in the first direction along the axis. The at least one biasing member may further include a second biasing member configured to bias the piston in a second direction along the axis, opposite to the first direction, wherein the zeroing member limits axial movement of the second biasing member in the second direction along the axis.

The piston may comprise a body portion and a protrusion extending from the body portion in a lateral direction perpendicular to the axis. The first biasing member may be configured to be axially supported on the protrusion and to bias the piston in the first direction when at least a portion of the protrusion extends beyond the zeroing member in the second direction. Additionally or alternatively, the second biasing member may be configured to be axially supported on the protrusion and to bias the piston in the second direction when at least a portion of the protrusion extends beyond the zeroing member in the first direction. An axial length of the protrusion may be equal to an axial length of the zeroing member.

The zeroing device may further comprise a first thrust ring axially disposed in between the the zeroing member and the first biasing member and in between the protrusion and the first biasing member so that the first biasing member is configured to be supported on the protrusion via the first thrust ring and to move the piston in the first direction until the first thrust ring hits the zeroing member or strikes against the zeroing member. Additionally or alternatively, the zeroing device may comprise a second thrust ring axially disposed in between the the zeroing member and the second biasing member and in between the protrusion and the second biasing member so that the second biasing member is configured to be supported on the protrusion via the second thrust ring and to move the piston in the second direction until the second thrust ring hits the zeroing member or strikes against the zeroing member.

The first biasing member and/or the second biasing member may at least partially enclose the piston. Or in other words, the first biasing member and/or the second biasing member may be at least partially received on the piston.

The zeroing device may comprise a housing. The piston may be received in a cylinder formed within the housing. The piston may be movable relative to the housing. A portion of the zeroing member may be received in a recess formed in the housing so that a portion of the housing enclosing the recess limits axial movement of the zeroing member. For example, the portion of the housing enclosing the recess may limit axial movement of the zeroing member in two opposing directions along the axis, for example both in the first direction and in the second direction along the axis. A maximum axial stroke of the zeroing member within the recess formed in the housing may be at most twenty percent or at most ten percent of an axial length of the recess. The at least one biasing member may be axially supported on the housing. For example, the first biasing member and/or the second biasing member may be axially supported on the housing.

The zeroing device may comprise a cap assembly closing the cylinder formed in the housing at an axial end thereof. The cap assembly may comprise an insertion portion received in the cylinder. The piston may be partially received in the insertion portion of the cap assembly received in the cylinder.

The zeroing device may comprise a hydraulic chamber formed axially in between the cap assembly and the piston. The piston may be configured to be biased and/or moved in the first direction along the axis by a hydraulic pressure in the hydraulic chamber.

The at least one biasing member may be axially supported on the housing via the cap assembly. For example, the above-mentioned first biasing member may be axially supported on the housing via the cap assembly. For instance, the cap assembly may be connected or fixed to the housing via one or more connection members such as screws or bolts or via a latch.

The cap assembly may comprise an outer sealing member disposed in between the insertion portion of the cap assembly and a cylinder wall enclosing the cylinder. The outer sealing member may be mounted on the insertion portion of the cap assembly. For example, the outer sealing member may include a sealing ring received in an annular indention formed in a radially outer surface of the insertion portion of the cap assembly. Additionally or alternatively, the cap assembly may comprise an inner sealing member disposed in between the insertion portion and the piston. The inner sealing member may be mounted on the insertion portion of the cap assembly. For example, the inner sealing member may include a sealing ring received in an annular indention formed in a radially inner surface of the insertion portion of the cap assembly.

The cylinder formed in the housing may have a cylindrical shape or a perfectly cylindrical shape. More specifically, a cylinder wall enclosing the cylinder may not include machined portions.

The presently proposed variable displacement hydraulic unit comprises at least a swashplate and the aforementioned zeroing device, wherein the piston of the zeroing device is coupled to the swashplate for swiveling the swashplate.

Embodiments of the presently proposed subject matter are illustrated in the accompanying drawing and are described in the following detailed description.

DETAILED DESCRIPTION

Figure 1:
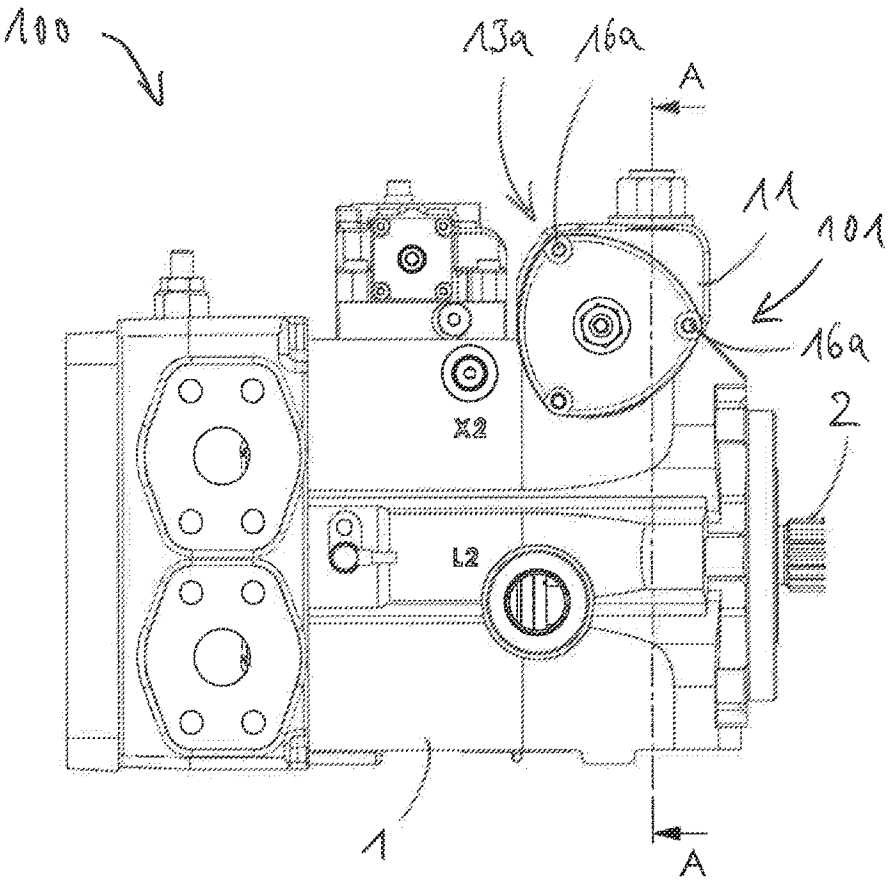
FIG. 1 schematically illustrates a plan view of a first embodiment of a variable displacement hydraulic unit including a zeroing device of the presently proposed type.
Figure 3:
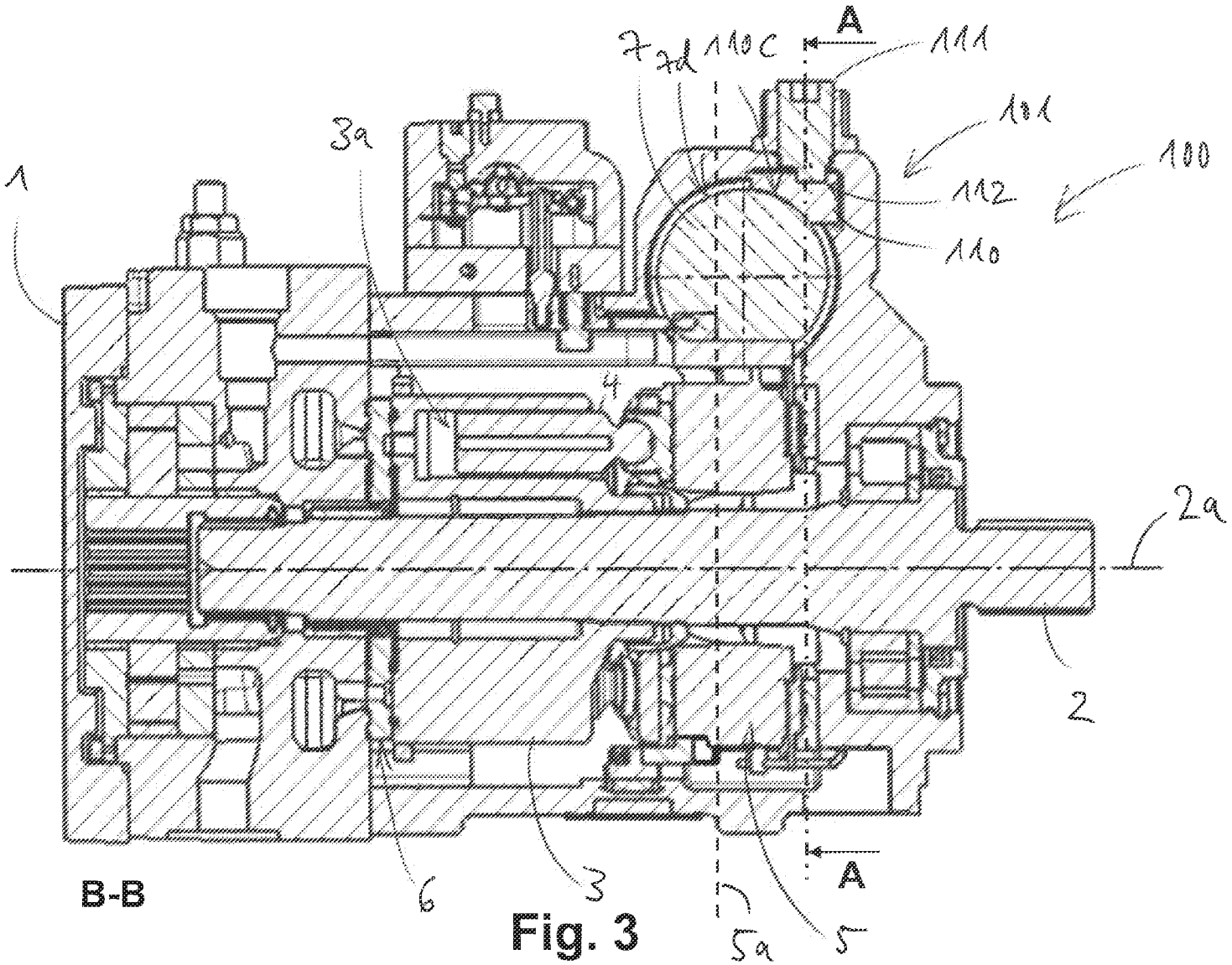
FIG. 3 schematically illustrates a second sectional view of the variable displacement hydraulic unit of FIG. 1.
Figure 4:
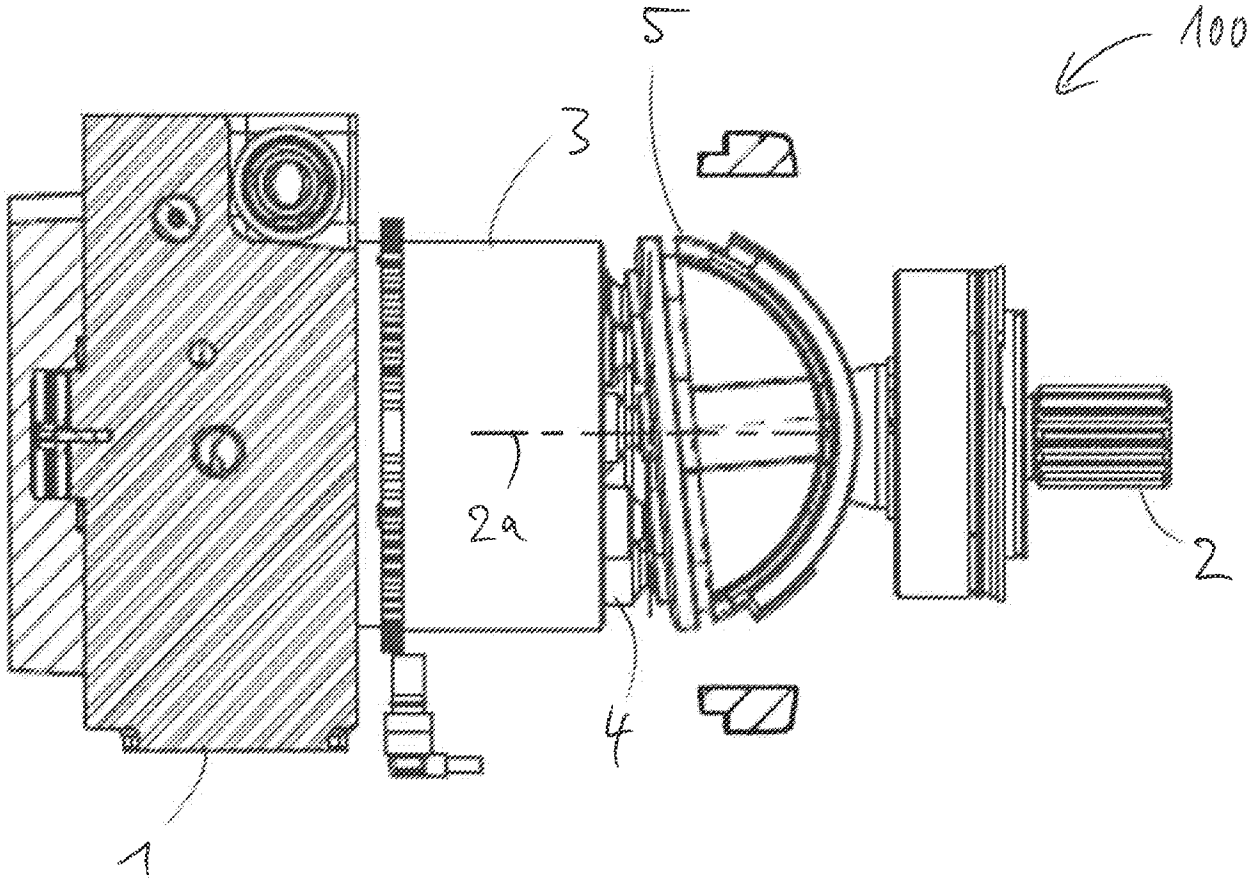
FIG. 4 schematically illustrates a plan view of elements the variable displacement hydraulic unit of FIG. 1, wherein a swashplate is in a tilted position.

FIG. 1 shows a plan view of a variable displacement hydraulic unit 100 of the presently proposed type according to a first embodiment. Here, the variable displacement hydraulic unit 100 is a variable displacement axial piston unit and may be used as a hydraulic pump or as a hydraulic motor. FIGS. 2 to 8 show various views of the hydraulic unit 100 of FIG. 1, wherein here and in all of the following, features recurring in different figures are designated with the same or similar reference signs. In FIG. 1, a dashed line A-A indicates the sectional plane of FIG. 2. And in FIG. 2, a dashed line B-B indicates the sectional plane of FIG. 3. The viewing direction of FIG. 4 is perpendicular to the viewing direction of FIG. 2 and perpendicular to the viewing direction of FIG. 3.

The hydraulic unit 100 includes a casing 1, a rotatable shaft 2 such as pump shaft or motor shaft at least partially disposed in the casing 1, a cylinder block 3 (see FIG. 3) rotationally coupled to the shaft 2, pistons 4 configured to reciprocate within cylinders 3*a* formed in the cylinder block 3, and a tiltable swashplate 5 (see FIGS. 3 and 4) configured to control a stroke of the pistons 4, as is generally known in the art of hydraulic devices. A rotation axis 5*a* of the swashplate 5 is arranged perpendicular to a rotation axis 2*a* of the rotatable shaft 2. The cylinders 3*a* are fluidically connected to a fluid inlet and to a fluid outlet, for example via a valve plate 6. Within the scope of this document the term fluid may include a liquid such as oil.

The hydraulic unit 100 further includes a zeroing device 101. More detailed views of the zeroing device 101 are depicted in FIGS. 5 to 8, for example. The zeroing device 101 includes a piston 7, for example a servo piston, movable along an axis 8 and mechanically coupled to the swashplate 5, biasing members 9*a*, 9*b* for biasing the piston 7 along the axis 8, and an axially displaceable zeroing member 110 configured to limit axial movement of the biasing members 9*a*, 9*b*. The piston 7 may move or may be moved in a first direction 8*a* along the axis 8 and in a second direction 8*b* along the axis 8, wherein the first axial direction 8*a* and the second axial direction 8*b* point in opposing directions along the axis 8. The piston 7 is configured to control a swivel angle of the swashplate 5 for controlling the stroke of the pistons 4. Here, the biasing member 9*a*, 9*b* are configured as helical compression springs.

In the embodiment depicted here, movement of the piston 7 along the axis 8 is controllable via hydraulic forces. When no net hydraulic force acts on the piston 7 along the axis 8, the biasing members 9*a*, 9*b* move the piston 7 back to a zero position. Ideally, in the zero position of the piston 7 the swashplate 5 is arranged perpendicular to the rotation axis 2*a* of the shaft 2 so that a stroke of the pistons 4 vanishes. Or in other words, when the piston 7 is in the zero position, the hydraulic unit 100 should be in a neutral configuration in which it does not displace fluid upon rotation of the shaft 2. However, due to manufacturing tolerances and/or mechanical wear the zero position of the piston 7 may not always exactly correspond to the neutral configuration of the hydraulic unit 100. Therefore, in order to make sure that the hydraulic unit 100 is in the neutral configuration when the piston 7 is in the zero position, the zero position of the piston 7 can be set or adjusted by displacing the zeroing member 110 along the axis 8, as will be explained in further detail below.

Figure 2:
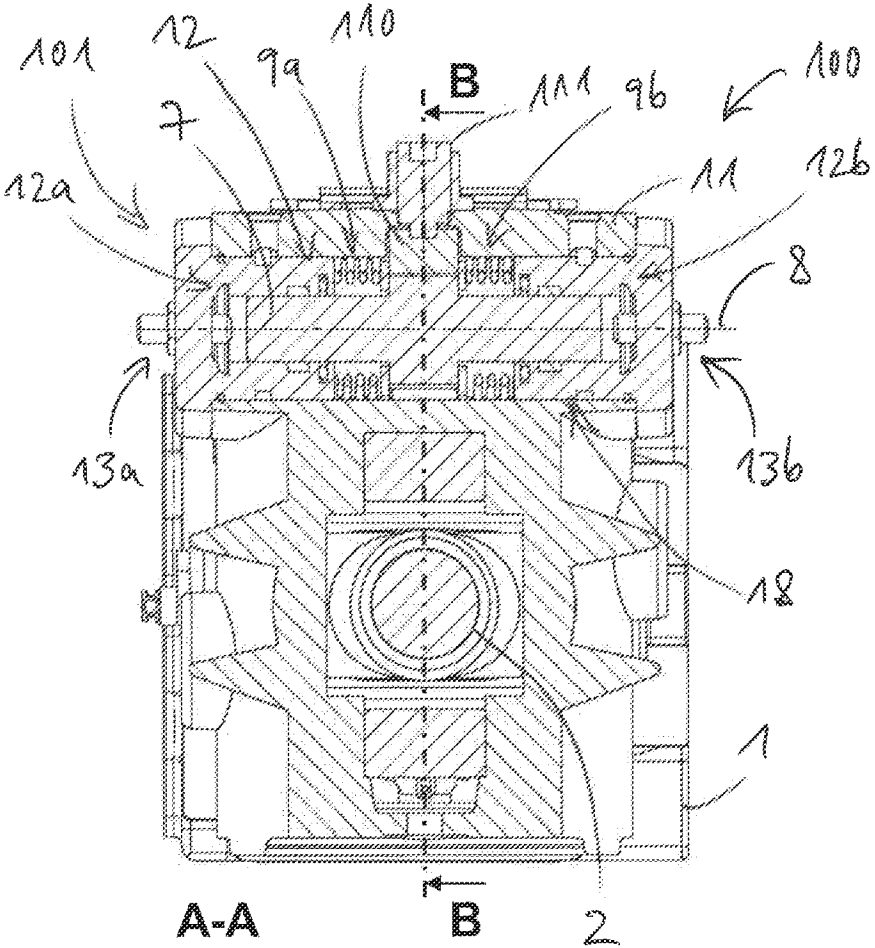
FIG. 2 schematically illustrates a first sectional view of the variable displacement hydraulic unit of FIG. 1.
Figure 5:
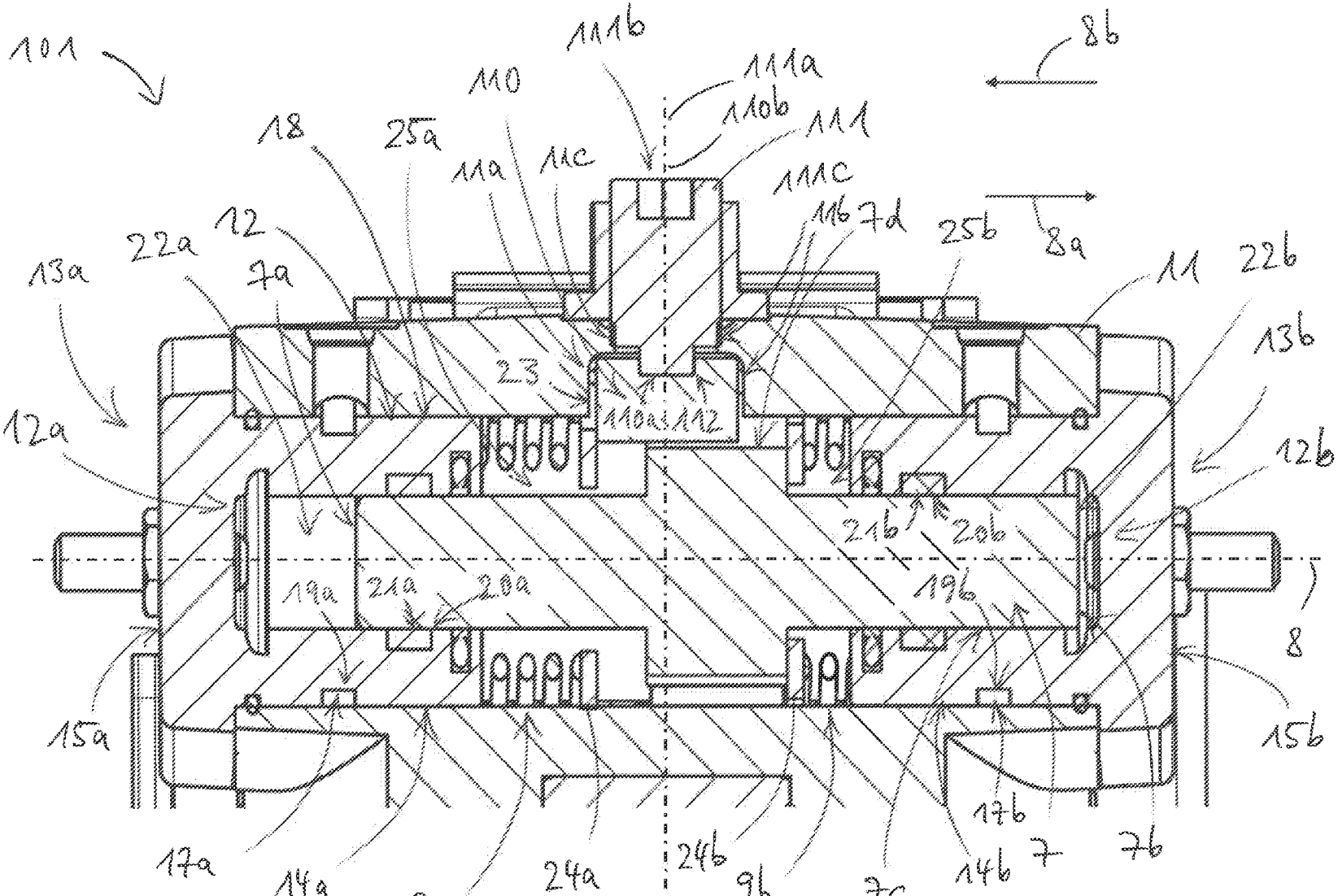
FIG. 5 illustrates a sectional view of the variable displacement hydraulic unit of FIGS. 1 to 4, wherein a piston of the zeroing device is deflected from a first zero position.

FIG. 5 shows a detail of FIG. 2. Specifically, FIG. 5 shows a sectional view of the zeroing device 101 of the hydraulic unit 100. The zeroing device 101 includes a housing 11. Here, the housing 11 of the zeroing device 101 is formed in one piece with the casing 1 enclosing the shaft 2 and the cylinder block 3. In alternative embodiments not explicitly depicted here, the housing 11 of the zeroing device 101 and the casing 1 may possibly be separate elements which may be connected to one another. The housing 11 forms a cylindrical cavity or cylinder 12 extending along the axis 8 from a first axial end 12*a* to a second axial end 12*b*. Here, the cylinder 12 is formed as a cylindrical boring in the housing 11. A cylinder wall 18 formed by the housing 11 does not feature any additional machined portions on or in its inner surface, making the hydraulic unit 100 and/or the zeroing device 101 may be easy to manufacture.

Along the axis 8, the first axial direction 8*a* points from the first axial end 12*a* of the cylinder 12 to the second axial end 12*b* of the cylinder 12, and the second axial direction 8*b* points from the second axial end 12*b* of the cylinder 12 to the first axial end 12*a* of the cylinder 12. The piston 7 is disposed within the cylinder 12. A cylinder axis of the cylinder 12 coincides with the axis 8. The piston 7 is movable relative to the housing 11. Along the axis 8 the piston 7 extends from a first axial end 7*a* to a second axial end 7*b*. The piston 7 includes a cylindrical or at least partially cylindrical body portion 7*c* extending along the axis 8 and a protrusion 7*d* extending from the body portion 7*c* in a lateral direction perpendicular to the axis 8. Here, at least a section of the protrusion 7*d* has an annular shape. The protrusion 7*d* runs around the body portion 7*c*. In the embodiment depicted here, the body portion 7*c* and the protrusion 7*d* are formed in one piece. The piston 7 may be forced or moved in the first axial direction 8*a* by a hydraulic pressure in a first hydraulic chamber 25*a*, and the piston 7 may be forced or moved in the second axial direction 8*b* by a hydraulic pressure in a second hydraulic chamber 25*b*. The hydraulic chambers 25*a*, 25*b* are formed within the cylinder 12.

The zeroing device 101 further includes a first cap assembly 13*a* which closes or seals off the cylinder 12 at its first axial end 12*a*. The first cap assembly 13*a* includes an insertion portion 14*a* extending along the axis 8, and a cap portion 15*a* extending perpendicular to the axis 8. Here, the insertion portion 14*a* and the cap portion 15*a* are formed in one piece. The first cap assembly 13*a* is fixed to the housing 11, for example by a plurality of screws 16*a* (see FIG. 1). Here, the screws 16*a* extend parallel to the axis 8 and fix the cap portion 15*a* to the housing 11. The insertion portion 14*a* of the first cap assembly 13*a* is received in the cylinder 12. The first cap assembly 13*a*, more specifically the insertion portion 14*a* of the first cap assembly 13*a*, delimits the first hydraulic chamber 25*a* in the second axial direction 8*b*.

Here, the insertion portion 14*a* has the shape of a hollow cylinder. An outer radius of the insertion portion 14*a* is equal to or just slightly smaller than a radius of the cylinder 12. The zeroing device 101 further includes at least one first outer sealing member 17*a* such as a rubber sealing ring. The first outer sealing member 17*a* is disposed radially in between the insertion portion 14*a* and the cylinder wall 18 enclosing the cylinder 12. The first outer sealing member 17*a* is mounted on the insertion portion 14*a*. More specifically, the first outer sealing member 17*a* is received in an outer indentation 19*a* formed in a radially outer surface of the insertion portion 14*a* of the first cap assembly 13*a*. The first outer sealing member 17*a* prevents fluid such as oil from leaking out of the cylinder 12.

The piston 7 or, more specifically, the body portion 7*c* of the piston 7 is partially received in the hollow cylindrical insertion portion 14*a* of the first cap assembly 13*a*. An inner radius of the hollow cylindrical insertion portion 14*a* is equal to or just slightly larger than a radius of the body portion 7*c* of the piston 7. The zeroing device 101 further includes at least one first inner sealing member 20*a* such as a rubber sealing ring. The first inner sealing member 20*a* is disposed radially in between the hollow cylindrical insertion portion 14*a* and the body portion 7*c* of the piston 7. The first inner sealing member 20*a* is mounted on the insertion portion 14*a*. More specifically, the first inner sealing member 20*a* is received in an inner indentation 21*a* formed in a radially inner surface of the hollow cylindrical insertion portion 14*a* of the first cap assembly 13*a*. The first inner sealing member 20*a* prevents fluid such as oil from leaking into a hollow 22*a* formed axially in between the piston 7 and the cap portion 15*a* of the first cap assembly 13*a*.

The zeroing device 101 further includes a second cap assembly 13*b* which closes or seals off the cylinder 12 at its second axial end 12*b*. The second cap assembly 13*b* includes an insertion portion 14*b* extending along the axis 8, and a cap portion 15*b* extending perpendicular to the axis 8. Here, the insertion portion 14*b* and the cap portion 15*b* are formed in one piece. The second cap assembly 13*b* is fixed to the housing 11, for example by a plurality of screws which may extend parallel to the axis 8 and fix the cap portion 15*b* to the housing 11 (not shown). The insertion portion 14*b* of the second cap assembly 13*b* is received in the cylinder 12. The second cap assembly 13*b*, more specifically the insertion portion 14*b* of the second cap assembly 13*b*, delimits the second hydraulic chamber 25*b* in the first axial direction 8*a*.

Here, the insertion portion 14*b* has the shape of a hollow cylinder. An outer radius of the insertion portion 14*b* is equal to or just slightly smaller than a radius of the cylinder 12. The zeroing device 101 further includes at least one second outer sealing member 17*b* such as a rubber sealing ring. The second outer sealing member 17*b* is disposed radially in between the insertion portion 14*b* and a cylinder wall 18 enclosing the cylinder 12. The second outer sealing member 17*b* is mounted on the insertion portion 14*b*. More specifically, the second outer sealing member 17*b* is received in an outer indentation 19*b* formed in a radially outer surface of the insertion portion 14*b* of the second cap assembly 13*b*. The second outer sealing member 17*b* prevents fluid such as oil from leaking out of the cylinder 12.

The piston 7 or, more specifically, the body portion 7*c* of the piston 7 is partially received in the hollow cylindrical insertion portion 14*b* of the second cap assembly 13*b*. An inner radius of the hollow cylindrical insertion portion 14*b* is equal to or just slightly larger than the radius of the body portion 7*c* of the piston 7. The zeroing device 101 further includes at least one second inner sealing member 20*b* such as a rubber sealing ring. The second inner sealing member 20*b* is disposed radially in between a radially inner wall of the hollow cylindrical insertion portion 14*b* and the body portion 7*c* of the piston 7. The second inner sealing member 20*b* is mounted on the insertion portion 14*b*. More specifically, the second inner sealing member 20*b* is received in an inner indentation 21*b* formed in a radially inner surface of the hollow cylindrical insertion portion 14*b* of the second cap assembly 13*b*. The second inner sealing member 20*b* prevents fluid such as oil from leaking into a hollow 22*b* formed axially in between the piston 7 and the cap portion 15*b* of the second cap assembly 13*b*.

The zeroing member 110 is partially received in a recess 23 formed in the housing 11. Portions 11*a*, 11*b* of the housing 11 enclosing the recess 23 limit movement of the zeroing member 110 along the axis 8. More specifically, the portion 11*a* limits movement of the zeroing member 110 in the second axial direction 8*b*, and the portion 11*b* limits movement of the zeroing member 110 in the first axial direction 8*a*. The zeroing member 110 protrudes partially into the cylinder 12. Here, a length or extension of the recess 23 along the axis 8 and a length or extension of the zeroing member 110 along the axis 8 are such that a maximum stroke of the zeroing member 110 along the axis 8 within the recess 23 is at most 20 percent or at most ten percent of the axial length or of the axial extension of the recess 23. As can be seen in FIG. 3, a radially inner surface 110*c* of the zeroing member 110 has an arcuate shape adapted to the arcuate outer surface of the protrusion 7*d* of the piston 7.

In the embodiment depicted in FIGS. 1 to 8, the zeroing device 101 further includes a rotatable gudgeon 111 for adjusting a position of the zeroing member 110 along the axis 8. A rotation axis 111*a* of the gudgeon 111 is arranged perpendicular to the axis 8. The gudgeon 111 is received or at least partially received in the housing 11. The gudgeon is accessible from outside the housing 11. For example, the gudgeon 111 may include a feature 111*b* for receiving a tool such as an Allen key, a screw driver, or the like. Here, the rotatable gudgeon 111 includes a male threaded portion 111*c* which is received in a corresponding female threaded portion 11*c* formed in the housing 11. At an axial end of the gudgeon 111 facing the zeroing member 110, the gudgeon 111 includes an eccentric pin 112. The eccentric pin 112 extends parallel to and is spaced from the rotation axis 111*a* of the gudgeon 111 along the axis 8. The eccentric pin 112 is engaged with the zeroing member 110. More specifically, the eccentric pin 112 of the gudgeon 111 is received in a corresponding recess 110*a* formed in the zeroing member 110. For example, the eccentric pin 112 may be received in the recess 110*a* in a form-fit. The axial position of the zeroing member 110 may be adjusted by rotating or turning the gudgeon 111 with respect to its rotation axis 111*a*.

The first biasing member 9*a* biases or is configured to bias the piston 7 in the first axial direction 8*a* along the axis 8. In the embodiment depicted here, the first biasing member 9*a* is received on and encloses or at least partially encloses the piston 7. More specifically, the first biasing member 9*a* is received on and encloses or at least partially encloses the body portion 7*c* of the piston 7. Along the axis 8, the first biasing member 9*a* is supported on the first cap assembly 13*a*. Further, along the axis 8 the first biasing member 9*a* is supported on either the zeroing member 110 or the protrusion 7*d* of the piston 7 at all times. Or in other words, the first biasing member 9*a* is preloaded or at least partially compressed in between the first cap assembly 13*a* and either the zeroing member 110 or the protrusion 7*d* of the piston 7 at all times. More specifically, along axis 8 the first biasing member 9*a* is supported on the insertion portion 14*a* of the first cap assembly 13*a*. Or in other words, along the axis 8 the first biasing member 9*a* is supported on the housing 11 via the first cap assembly 13*a*.

Along the axis 8, the first biasing member 9*a* is disposed in between the first cap assembly 13*a* and the protrusion 7*d* of the piston 7. More specifically, along the axis 8 the first biasing member 9*a* is disposed in between the insertion portion 14*a* of the first cap assembly 13*a* and the protrusion 7*d* of the piston 7. Along the axis 8 the first biasing member 9*a* is disposed in between the first cap assembly 13*a* and the zeroing member 110. More specifically, along the axis 8 the first biasing member 9*a* is disposed in between the insertion portion 14*a* of the first cap assembly 13*a* and the zeroing member 110.

The zeroing device 101 further includes a first thrust ring 24*a*. Along the axis 8 the first thrust ring 24*a* is disposed in between the first biasing member 9*a* and the zeroing member 110 and in between the first biasing member 9*a* and the protrusion 7*d* of the piston 7. The first thrust ring 24*a* is received on the piston 7, more specifically on the body portion 7*c* of the piston 7. In the radial direction perpendicular to the axis 8, the first thrust ring 24*a* at least partially overlaps with the zeroing member 110. Or in other words, with respect to the axis 8 a maximum radius of the first thrust ring 24*a* determined perpendicular to the axis 8 is larger than a minimum radius of the zeroing member 110 determined perpendicular to the axis 8. Further, in the radial direction the first thrust ring 24*a* at least partially overlaps with the protrusion 7*d* of the piston 7. Or in other words, with respect to the axis 8 a minimum radius of the first thrust ring 24*a* determined perpendicular to the axis 8 is smaller than a maximum radius of the protrusion 7*d* determined perpendicular to the axis 8.

Thus, along the axis 8 the first biasing member 9*a* is configured to be supported on the protrusion 7*d* via the first thrust ring 24*a* and to move the piston 7*d* in the first axial direction 8*a* when or as long as the protrusion 7*d* extends or at least partially extends beyond the zeroing member 110 in the second axial direction 8*d* until the first thrust ring 24*a* hits or strikes against the zeroing member 110. A biasing force the first biasing member 9*a* exerts on the zeroing member 110 and a frictional force between the rotatable gudgeon 111 and the housing 11 are such that the first biasing member 9*a* may not move the zeroing member 110 along the axis 8 against the frictional force between the rotatable gudgeon 111 and the housing 11. In this way, the zeroing member 110 limits movement of the first biasing member 9*a* in the first axial direction 8*a*.

The second biasing member 9*b* biases or is configured to bias the piston 7 in the second axial direction 8*b* along the axis 8. In the embodiment depicted here, the second biasing member 9*b* is received on and encloses or at least partially encloses the piston 7. More specifically, the second biasing member 9*b* is received on and encloses or at least partially encloses the body portion 7*c* of the piston 7. Along the axis 8, the second biasing member 9*b* is supported on the second cap assembly 13*b*. Further, along the axis 8 the second biasing member 9*b* is supported on either the zeroing member 110 or the protrusion 7*d* of the piston 7 at all times. Or in other words, the second biasing member 9*b* is preloaded or at least partially compressed in between the second cap assembly 13*b* and either the zeroing member 110 or the protrusion 7*d* of the piston 7 at all times. More specifically, along axis 8 the second biasing member 9*b* is supported on the insertion portion 14*b* of the second cap assembly 13*b*. Or in other words, along the axis 8 the second biasing member 9*b* is supported on the housing 11 via the second cap assembly 13*b*.

Along the axis 8 the second biasing member 9*b* is disposed in between the second cap assembly 13*b* and the protrusion 7*d* of the piston 7. More specifically, along the axis 8 the second biasing member 9*b* is disposed in between the insertion portion 14*b* of the second cap assembly 13*b* and the protrusion 7*d* of the piston 7. Along the axis 8, the second biasing member 9*b* is disposed in between the second cap assembly 13*b* and the zeroing member 110. More specifically, along the axis 8 the second biasing member 9*b* is disposed in between the insertion portion 14*b* of the second cap assembly 13*b* and the zeroing member 110.

The zeroing device 101 further includes a second thrust ring 24*b*. Along the axis 8, the second thrust ring 24*b* is disposed in between the second biasing member 9*b* and the zeroing member 110 and in between the second biasing member 9*b* and the protrusion 7*d* of the piston 7. The second thrust ring 24*b* is received on the piston 7, more specifically on the body portion 7*c* of the piston 7. In the radial direction perpendicular to the axis 8, the second thrust ring 24*b* at least partially overlaps with the zeroing member 110. Or in other words, with respect to the axis 8 a maximum radius of the second thrust ring 24*b* determined perpendicular to the axis 8 is larger than a minimum radius of the zeroing member 110 determined perpendicular to the axis 8. Further, in the radial direction the second thrust ring 24*b* at least partially overlaps with the protrusion 7*d* of the piston 7. Or in other words, with respect to the axis 8 a minimum radius of the second thrust ring 24*b* determined perpendicular to the axis 8 is smaller than a maximum radius of the protrusion 7*d* determined perpendicular to the axis 8.

Thus, along the axis 8 the second biasing member 9*b* is configured to be supported on the protrusion 7*d* via the second thrust ring 24*b* and to move the piston 7*d* in the second axial direction 8*b* when or as long as the protrusion 7*d* extends or at least partially extends beyond the zeroing member 110 in the first axial direction 8*a* until the second thrust ring 24*b* hits or strikes against the zeroing member 110. A biasing force the second biasing member 9*b* exerts on the zeroing member 110 and a frictional force between the rotatable gudgeon 111 and the housing 11 are such that the second biasing member 9*b* may not move the zeroing member 110 along the axis 8 against the frictional force between the rotatable gudgeon 111 and the housing 11. In this way, the zeroing member 110 limits movement of the second biasing member 9*b* in the second axial direction 8*b*.

Figure 6:
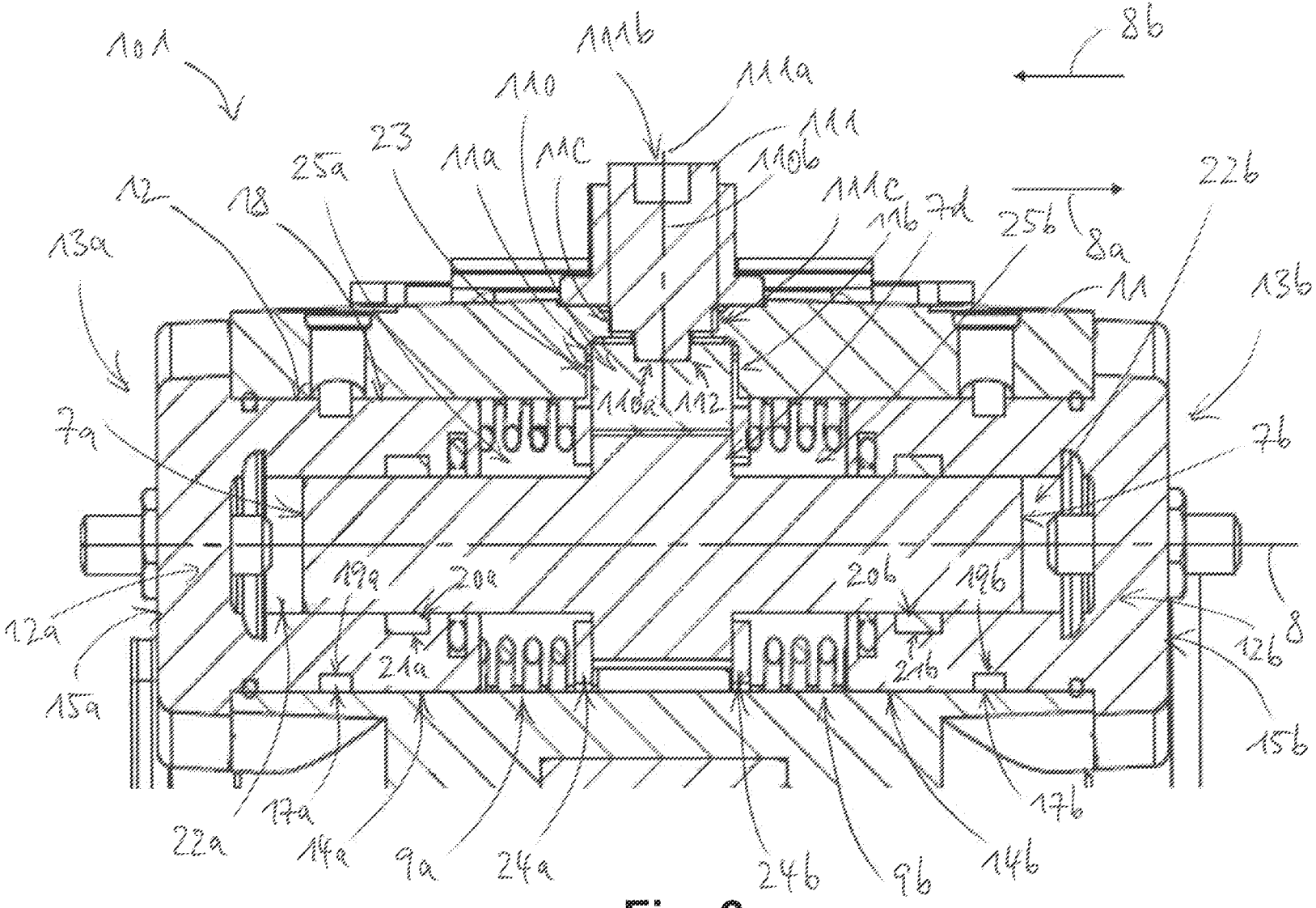
FIG. 6 illustrates the sectional view of FIG. 5, wherein the piston of the zeroing device has been moved back to the first zero position.

In FIGS. 5 and 6, the rotatable gudgeon 111 fixes the zeroing member 110 in a first position along the axis 8. For example, in the first position of the zeroing member 110 depicted in FIGS. 5 and 6, a center line 110*b* of the zeroing member 110 may coincide with the rotation axis 111*a* of the rotatable gudgeon 111. In FIG. 5, a hydraulic pressure in the first hydraulic chamber 25*a* is higher than a hydraulic pressure in the second hydraulic chamber 25*b* and deflects the piston 7 in the first axial direction 8*a* and away from a first zero position of the piston 7 set by the first position of the zeroing member 110, against a biasing force exerted on the piston 7 by the second biasing member 9*b* acting in the second axial direction 8*b*. In the deflected position of FIG. 5, the piston 7 at least partially compresses the second biasing member 9*b* in between the second thrust ring 24*b* and the second cap assembly 13*b*. At the same time, the first biasing member 9*a* presses the first thrust ring 24*a* against the zeroing member 110, the zeroing member 110 thereby limiting movement or further movement of the first biasing member 9*a* in the first axial direction 8*a*. In the deflected position of the piston 7 illustrated in FIG. 5, the piston 7 may swivel the swashplate 5 to a position such as the one shown in FIG. 4 where the swashplate 5 sets a stroke of the pistons 4 reciprocating within the cylinder block 3 to a non-zero value so that the hydraulic 100 is configured to displace fluid upon rotation of the shaft 2.

As, starting from the situation illustrated in FIG. 5, the hydraulic pressure in the first hydraulic chamber 25*a* is reduced to the hydraulic pressure in the second hydraulic chamber 25*b* so that no net hydraulic force acts on the piston 7 along the axis 8. The second biasing member 9*b* pushes the piston 7 in the second axial direction 8*b* until the second thrust ring 24*b* strikes against the zeroing member 110 so that the zeroing member 110 limits further movement of the second biasing member 9*b* in the second axial direction 8*b*.

The resulting situation is depicted in FIG. 6 where the biasing members 9*a*, 9*b* press the thrust rings 24*a*, 24*b* against the zeroing member 110 on opposing sides of the zeroing member 110 along the axis 8. Or in other words, in FIG. 6 the thrust rings 24*a*, 24*b* abut the zeroing member 110 on opposing sides of the zeroing member 110 along the axis 8. In this situation, the position of the protrusion 7*d* along the axis 8 is restricted to a space in between the thrust rings 24*a*, 24*b* set by the extension of the zeroing member 110 along the axis 8. Or in other words, in the first zero position of the piston 7 depicted in FIG. 6, the protrusion 7*d* overlaps with the zeroing member 110 along the axis 8. In the embodiment depicted here, a length or an extension of the protrusion 7*d* of the piston 7 along the axis 8 is equal to the extension of the zeroing member 110 along the axis 8. Consequently, the axial position of the zeroing member 110 set by the rotatable gudgeon 111 precisely sets the zero position of the piston 7 along the axis 8.

Figure 7:
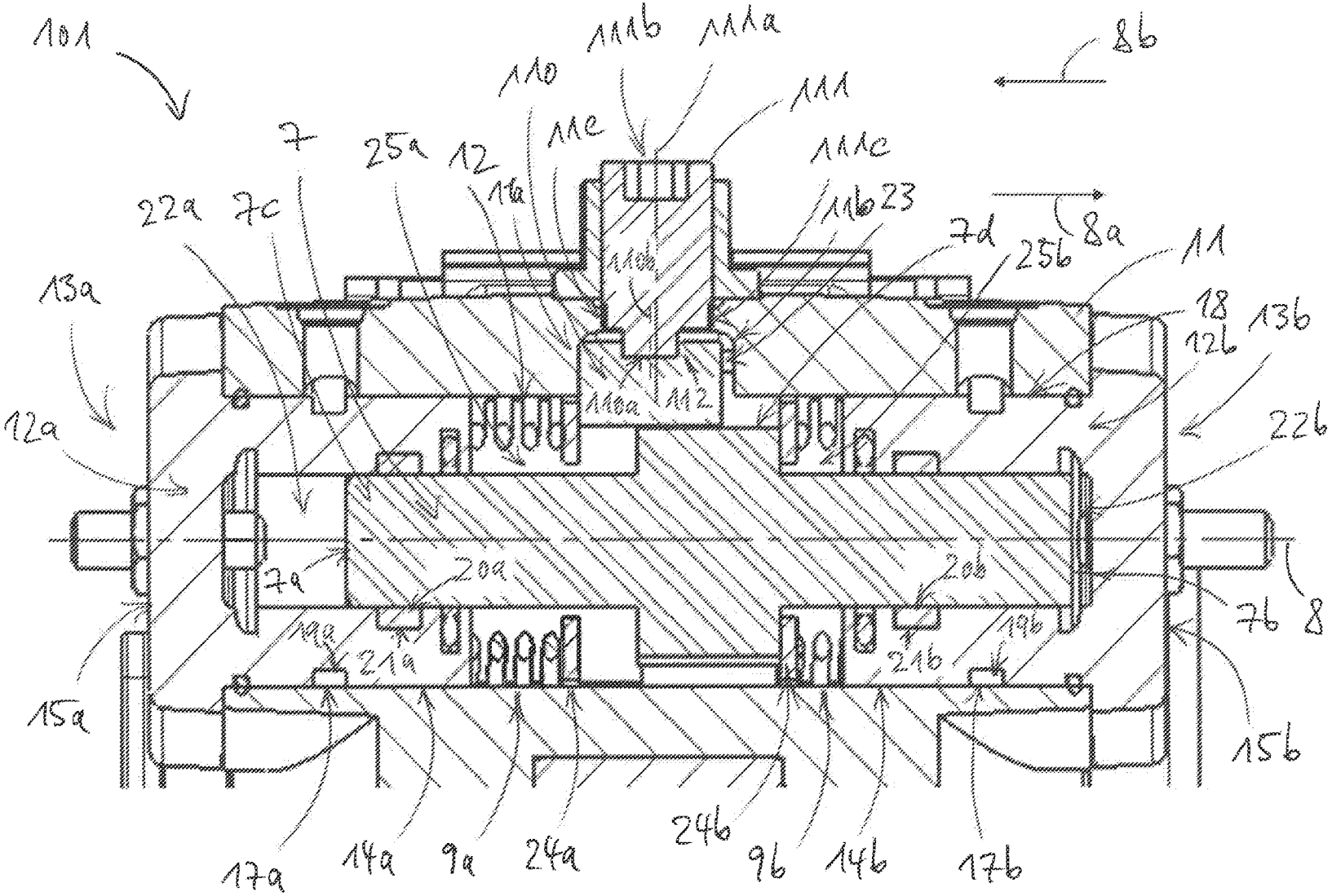
FIG. 7 illustrates a sectional view of the variable displacement hydraulic unit of FIGS. 1 to 4, wherein the piston of the zeroing device is deflected from a second zero position.
Figure 8:
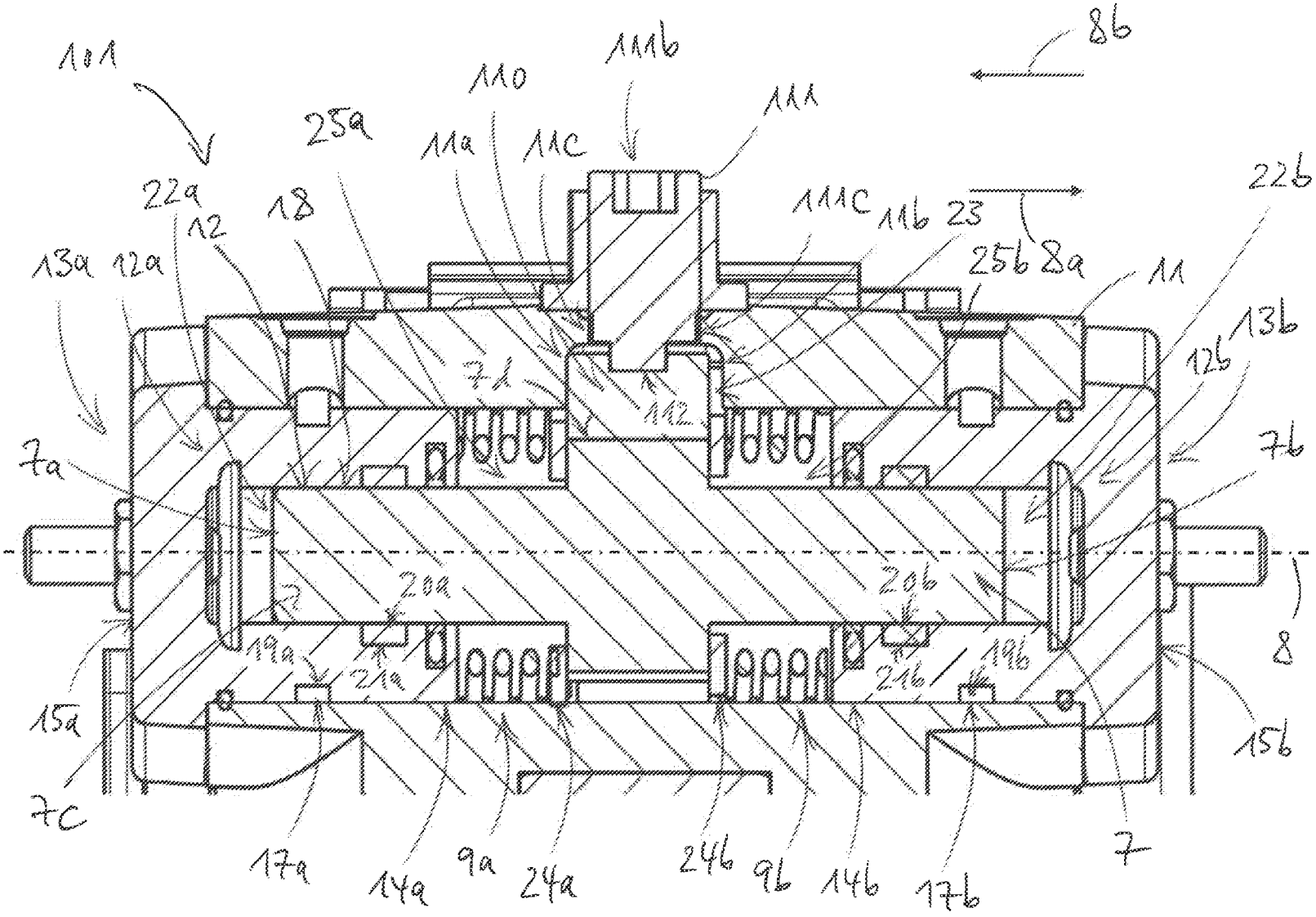
FIG. 8 illustrates the sectional view of FIG. 7, wherein the piston of the zeroing device has been moved back to the second zero position.

In FIGS. 7 and 8, the rotatable gudgeon 111 fixes the zeroing member 110 in a second axial position which is different from the first axial position of the zeroing member 110 depicted in FIGS. 5 and 6. As explained above, adjusting the axial position of the zeroing member 110 by turning the gudgeon 111 may be required to make sure that the zero position of the piston 7 along the axis 8 set or determined by the axial position of the zeroing member 110 corresponds to the neutral configuration of the hydraulic unit 100 with good accuracy. As a reminder, in the neutral configuration of the hydraulic unit 100 a stroke of the pistons 4 reciprocating in the cylinder block 3 vanishes. For example, in the second axial position of the zeroing member 110 depicted in FIGS. 7 and 8, the center line 110*b* of the zeroing member 110 is spaced from the rotation axis 111*a* of the rotatable gudgeon 111 along the axis 8.

Similar to the situations shown in FIGS. 5 and 6, FIG. 7 shows the piston 7 deflected from a second zero position of the piston 7 along the axis 8 set by the second axial position of the zeroing member 110. By contrast, in FIG. 8 no net hydraulic force acts on the piston 7 along the axis 8 and the biasing members 9*a*, 9*b* fix the piston 7 in the second zero position set by the second axial position of the zeroing member 110. Again, in FIG. 8 the position of the protrusion 7*d* along the axis 8 is restricted to a space in between the thrust rings 24*a*, 24*b* set by the extension of the zeroing member 110 along the axis 8. Or in other words, in the second zero position of the piston 7 depicted in FIG. 8, the protrusion 7*d* overlaps with the zeroing member 110 along the axis 8.

Figure 9:
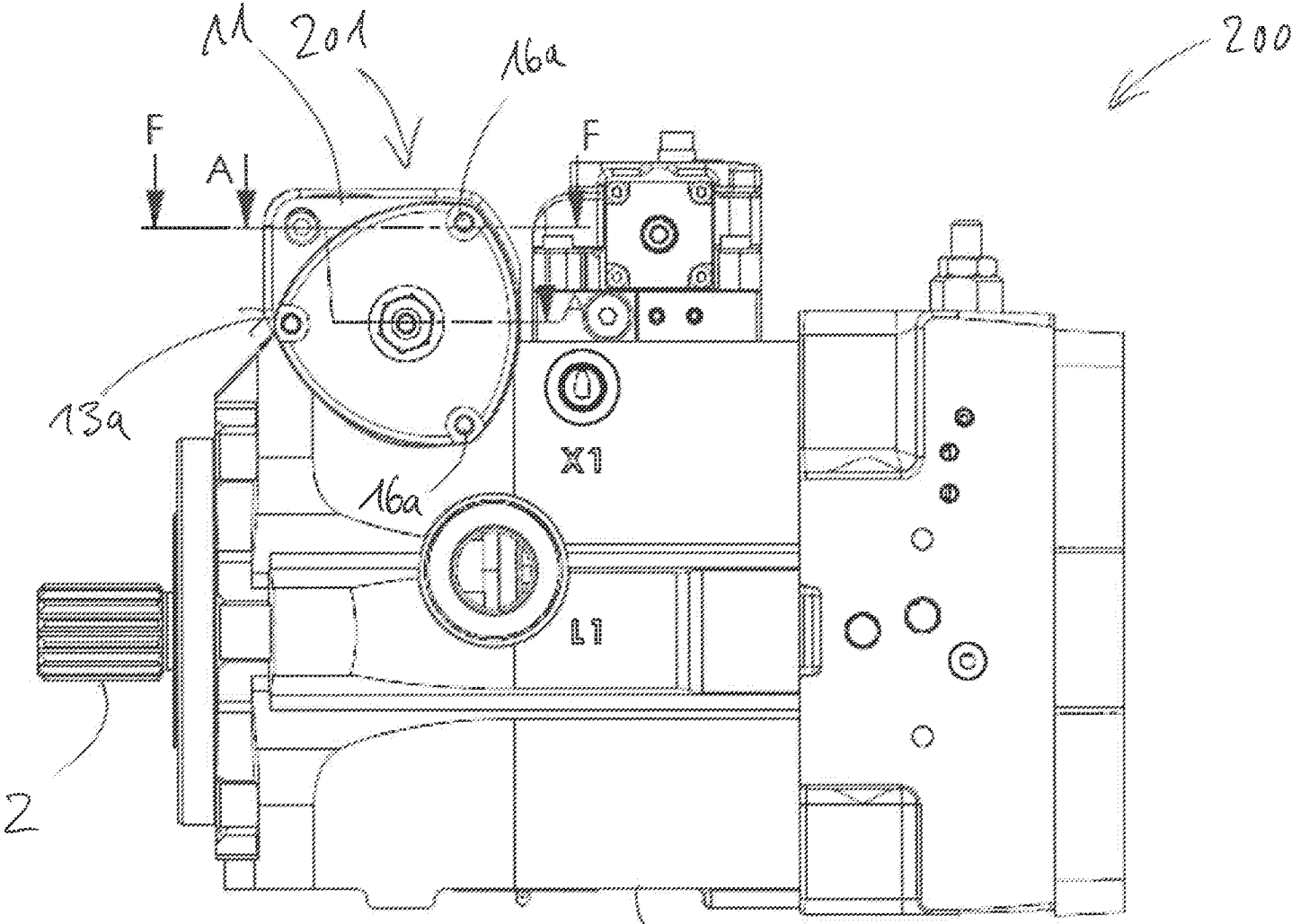
FIG. 9 schematically illustrates a plan view of a second embodiment of a variable displacement hydraulic unit including a zeroing device of the presently proposed type.
Figure 10:
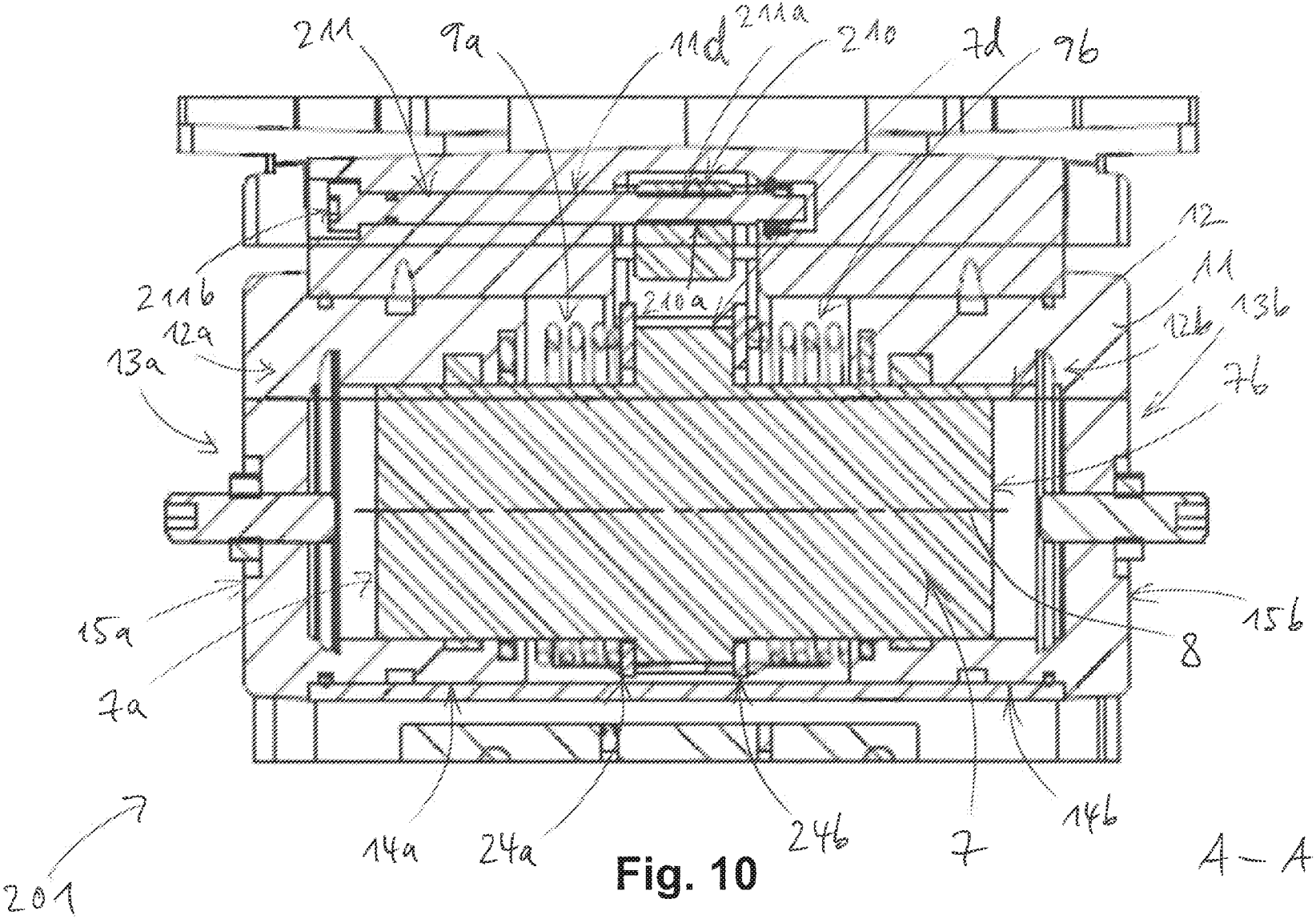
FIG. 10 schematically illustrates a first sectional view of the zeroing device of FIG. 9.
Figure 11:
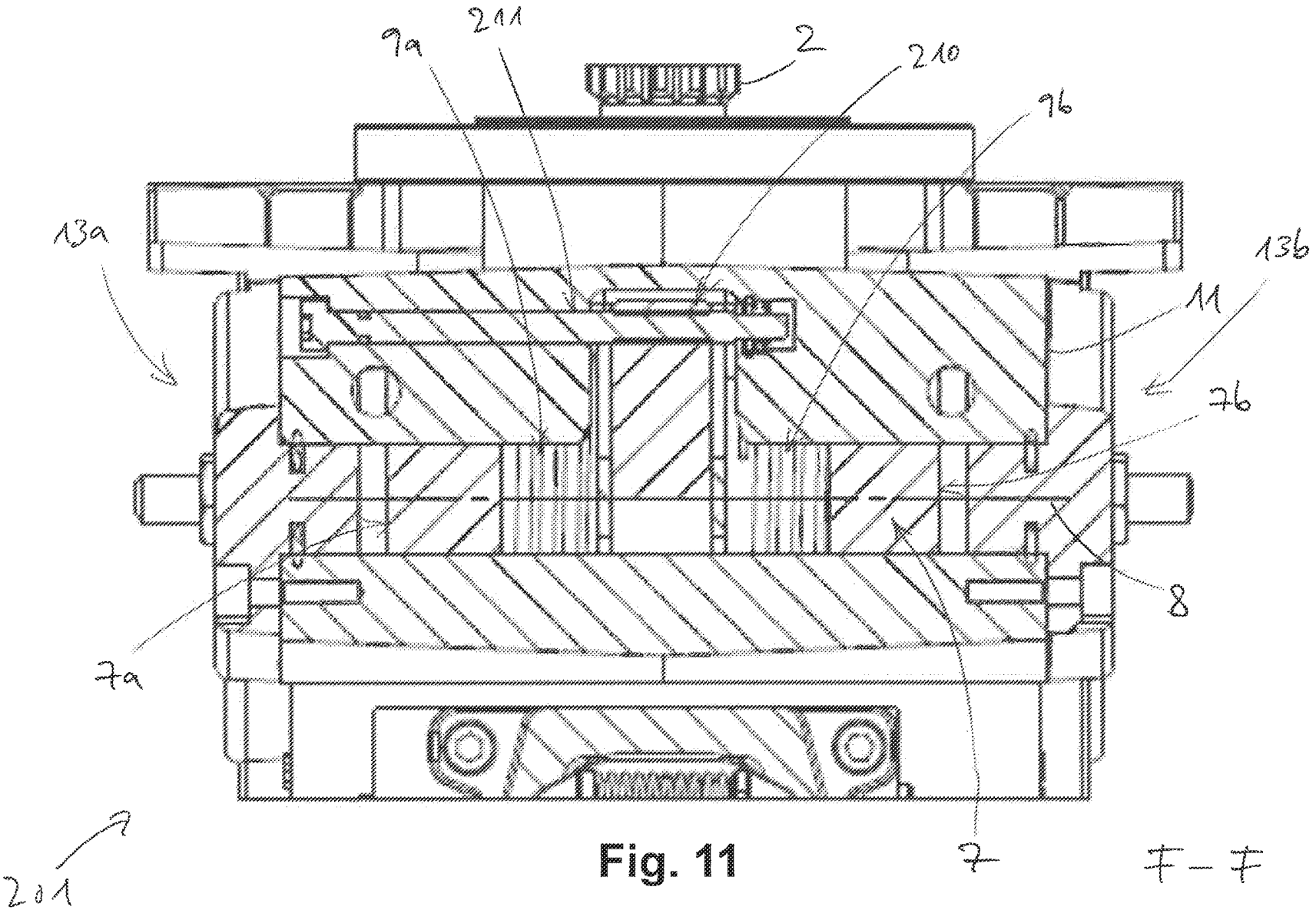
FIG. 11 schematically illustrates a second sectional view of the zeroing device of FIG. 9.
Figure 12:
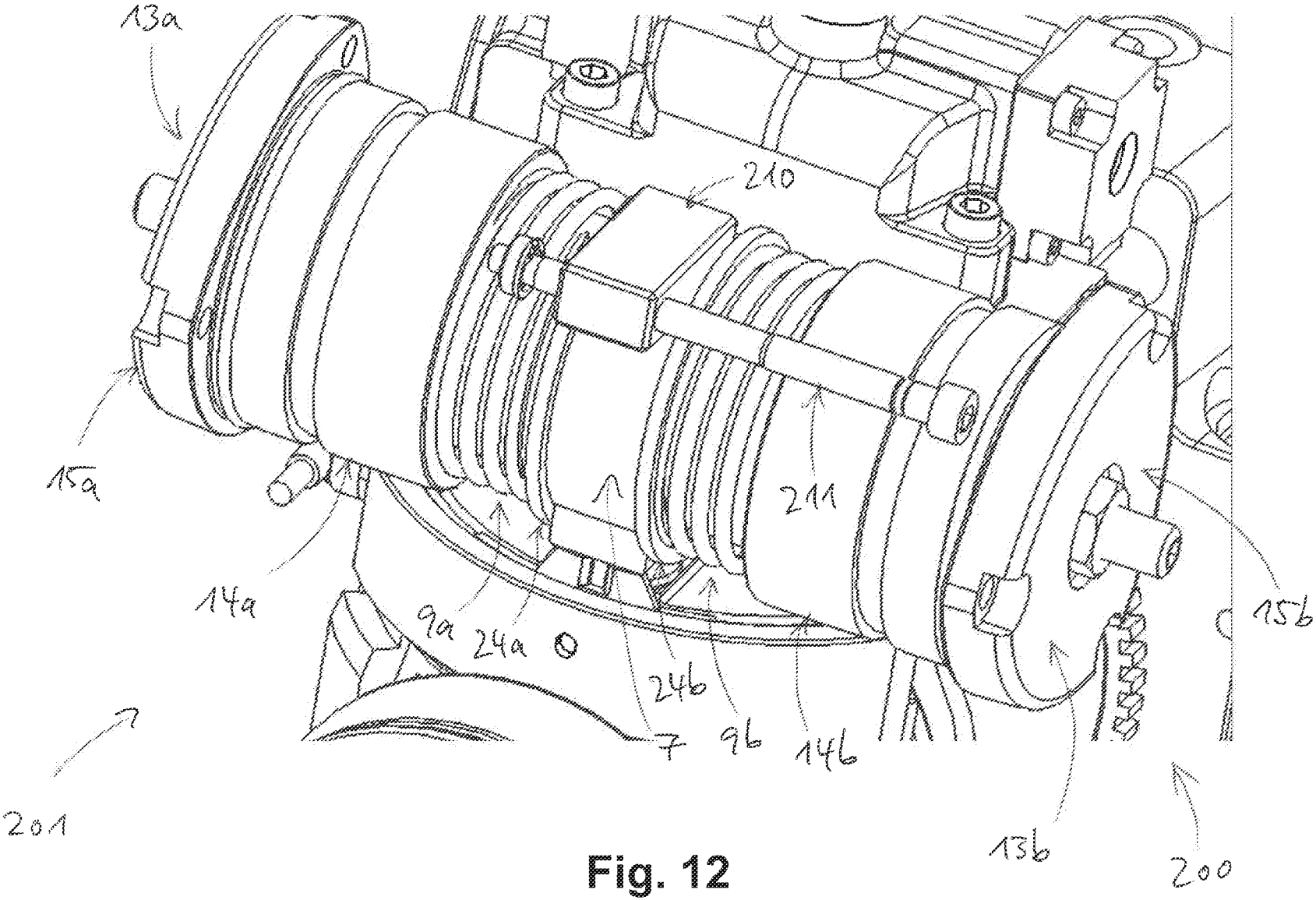
FIG. 12 schematically illustrates a perspective view of the zeroing device of FIG. 9.

FIGS. 9 to 12 show a variable displacement hydraulic unit 200 of the presently proposed type according to a second embodiment. The hydraulic unit 200 of FIGS. 9 to 12 is a variation of the hydraulic unit 100 of FIGS. 1 to 8. The hydraulic unit 200 is a variable displacement axial piston unit and may be used as a hydraulic pump or as a hydraulic motor. FIGS. 10 and 11 show different sectional views of the hydraulic unit 200 of FIG. 9. In FIG. 9, a straight dashed line A-A indicates the sectional plane of FIG. 10, and a step-like dashed line F-F indicates the section of FIG. 11. FIG. 12 shows a perspective view of elements of a zeroing device 201 of the hydraulic unit 200. As before, features recurring in different figures are designated with the same or similar reference signs.

Like the hydraulic unit 100 of FIGS. 1 to 8, the hydraulic unit 200 includes a casing 1, a rotatable shaft 2 such as pump shaft or motor shaft at least partially disposed in the casing 1, and a zeroing device 201. Further, the hydraulic unit 200 of FIGS. 9 to 12 typically includes a cylinder block rotationally coupled to the shaft, pistons configured to reciprocate within cylinders formed in the cylinder block, and a tiltable swashplate configured to control a stroke of the pistons (not shown), as is generally known in the art of hydraulic devices. Again, a rotation axis of the swashplate may be arranged perpendicular to the rotation axis of the rotatable shaft 2.

For the sake of brevity and simplicity, in the following only those features of the hydraulic unit 200 of FIGS. 9 to 12 which distinguish it from the hydraulic unit 100 of FIGS. 1 to 8 will be described in some detail. Unless explicitly stated otherwise, the hydraulic unit 200 of FIGS. 9 to 12 may include the same features as the hydraulic unit 100 of FIGS. 1 to 8. The differences between the hydraulic units 100 and 200 primarily concern differences between the zeroing device 101 of the hydraulic unit 100 and the zeroing device 201 of the hydraulic unit 200.

In contrast to the zeroing device 101 of the hydraulic unit 100 of FIGS. 1 to 8, the zeroing device 201 of the hydraulic unit 200 of FIGS. 9 to 12 includes a worm screw or lead screw 211 which is engaged with the zeroing member 210 of the zeroing device 201 so that the zeroing member 210 is displaceable along the axis 8 by rotating the worm screw or leadscrew 211. The worm screw or lead screw 211 includes a male threaded portion 211*a* which is engaged with a corresponding toothed portion 210*a* formed in the zeroing member 210. The worm screw or leadscrew 211 is arranged or extends parallel to the axis 8. The worm screw or leadscrew 211 is received in a cylindrical recess 11*d* formed in the housing 11. Along the axis 8 the worm screw or leadscrew 211 is fixed relative to the housing 11 in such a way that it does not move along the axis 8 when rotating. The worm screw or leadscrew 211 is accessible from outside the housing 11. For example, the worm screw or leadscrew 211 may include a feature 211*b* for receiving a tool such as an Allen key, a screw driver, or the like. Here, the worm screw or leadscrew 211 extends through the zeroing member 210.

FIGS. 1-12 are drawn to scale, although other relative dimensions may be used, if desired. FIGS. 1-12 show example configurations with relative positioning of the various components. Unless otherwise noted, if shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention claimed is:

1. A zeroing device, comprising:

a piston movable along an axis, at least one biasing member for biasing the piston along the axis, an axially displaceable zeroing member limiting axial movement of the at least one biasing member;

a housing, wherein the piston is received in a cylinder formed within the housing and wherein the piston is movable relative to the housing; and a cap assembly closing the cylinder formed in the housing at an axial end thereof, the cap assembly comprising an insertion portion received in the cylinder, wherein the piston is partially received in the insertion portion of the cap assembly.

2. The zeroing device of claim 1, further comprising a rotatable gudgeon including an eccentric pin engaged with the zeroing member so that the zeroing member is displaceable along the axis by rotating the rotatable gudgeon.

3. The zeroing device of claim 1, further comprising a worm screw engaged with the zeroing member so that the zeroing member is displaceable along the axis by rotating the worm screw.

4. The zeroing device of claim 1, wherein the at least one biasing member includes a first biasing member configured to bias the piston in a first axial direction, wherein the zeroing member limits axial movement of the first biasing member in the first axial direction.

5. The zeroing device of claim 4, wherein the at least one biasing member further includes a second biasing member configured to bias the piston in the second axial direction, opposite to the first axial direction, wherein the zeroing member limits axial movement of the second biasing member in the second axial direction.

6. The zeroing device of claim 5, wherein the piston comprises a body portion and a protrusion extending from the body portion in a lateral direction perpendicular to the axis, wherein the first biasing member is configured to be axially supported on the protrusion and to bias the piston in the first axial direction when at least a portion of the protrusion extends beyond the zeroing member in the second axial direction, and wherein the second biasing member is configured to be axially supported on the protrusion and to bias the piston in the second axial direction when at least a portion of the protrusion extends beyond the zeroing member in the first axial direction.

7. The zeroing device of claim 6, wherein an axial length of the protrusion is equal to an axial length of the zeroing member.

8. The zeroing device of claim 6, further comprising:

a first thrust ring axially disposed in between the zeroing member and the first biasing member and axially disposed in between the protrusion and the first biasing member so that the first biasing member is configured to be supported on the protrusion via the first thrust ring and to move the piston in the first axial direction until the first thrust ring hits the zeroing member, and a second thrust ring axially disposed in between the zeroing member and the second biasing member and axially disposed in between the protrusion and the second biasing member so that the second biasing member is configured to be supported on the protrusion via the second thrust ring and to move the piston in the second axial direction until the second thrust ring hits the zeroing member.

9. The zeroing device of claim 4, wherein the first biasing member and/or the second biasing member at least partially enclose/encloses the piston.

10. The zeroing device of claim 1, wherein a portion of the zeroing member is received in a recess formed in the housing so that a portion of the housing enclosing the recess limits axial movement of the zeroing member.

11. The zeroing device of claim 1, wherein the portion of the housing enclosing the recess limits axial movement of the zeroing member in two opposing axial directions.

12. The zeroing device of claim 1, wherein a maximum axial stroke of the zeroing member within the recess formed in the housing is at most ten percent of an axial length of the recess.

13. The zeroing device of claim 1, wherein the at least one biasing member is axially supported on the housing.

14. The zeroing device of claim 1, further comprising a hydraulic chamber formed axially in between the cap assembly and the piston, wherein the piston is configured to be biased in a direction along the axis by a hydraulic pressure in the hydraulic chamber.

15. The zeroing device of claim 1, wherein the at least one biasing member is axially supported on the housing via the cap assembly.

16. The zeroing device of claim 1, wherein the cap assembly comprises an outer sealing member disposed in between the insertion portion of the cap assembly and a cylinder wall enclosing the cylinder, wherein the outer sealing member is mounted on the insertion portion of the cap assembly.

17. The zeroing device of claim 1, wherein the cap assembly comprises an inner sealing member disposed in between the insertion portion and the piston, wherein the inner sealing member is mounted on the insertion portion of the cap assembly and/or wherein the cylinder formed in the housing has a cylindrical shape and a cylinder wall enclosing the cylinder does not include machined portions.

18. A variable displacement hydraulic unit, comprising:

a swashplate, and the zeroing device of claim 1, wherein the piston of the zeroing device is coupled to the swashplate for swiveling the swashplate.

* * * * *